United States Patent [19]

Chen

[11] Patent Number: 5,053,568

[45] Date of Patent: Oct. 1, 1991

[54] LUBRICANT COMPOSITIONS COMPRISING COPOLYMERS OF 1-VINYLADAMANTANE AND 1-ALKENES AND METHODS OF PREPARING THE SAME

[75] Inventor: Catherine S. H. Chen, Berkeley Heights, N.J.

[73] Assignee: Mobil Oil Corp., Fairfax, Va.

[21] Appl. No.: 614,328

[22] Filed: Nov. 15, 1990

[51] Int. Cl.[5] ..... C10M 107/10

[52] U.S. Cl. ..... 585/21; 585/22; 585/352; 252/9

[58] Field of Search ..... 585/21, 22, 352

[56] References Cited

U.S. PATENT DOCUMENTS

| | | | |
|---|---|---|---|
| 3,457,318 | 7/1969 | Capaldi et al. | 260/666 |
| 3,560,578 | 2/1971 | Schneider | 260/648 |
| 3,580,964 | 5/1971 | Driscoll | 260/871 |
| 3,639,362 | 2/1972 | Duling et al. | 260/78.5 |
| 3,649,702 | 3/1972 | Pincock et al. | 260/666 |
| 3,655,782 | 4/1972 | Moore | 585/21 |
| 3,676,521 | 7/1972 | Stearns et al. | 260/683 |
| 3,737,477 | 6/1973 | Stearns et al. | 260/683.15 |
| 3,748,359 | 7/1973 | Thompson | 260/563 |
| 3,832,332 | 8/1974 | Thompson | 260/78 |
| 3,851,011 | 11/1974 | Stearns et al. | 260/683.15 |
| 3,903,001 | 2/1975 | Gates et al. | 252/32.7 |
| 3,903,301 | 2/1975 | Share | 424/321 |
| 3,923,919 | 12/1975 | Stearns et al. | 260/683.1 |
| 3,928,480 | 12/1975 | Takushi et al. | 585/352 |
| 3,966,624 | 6/1976 | Duling et al. | 252/52 |
| 3,972,243 | 8/1976 | Driscoll et al. | 74/200 |
| 3,976,665 | 8/1976 | Feinstein et al. | 260/346.3 |
| 4,043,927 | 8/1977 | Duling et al. | 252/52 |
| 4,082,723 | 4/1978 | Mayer et al. | 260/45.8 |
| 4,142,036 | 2/1979 | Feinstein et al. | 528/183 |
| 4,168,260 | 9/1979 | Wiezer et al. | 260/45.8 |
| 4,182,922 | 1/1980 | Schick et al. | 585/18 |
| 4,239,927 | 12/1980 | Brennan et al. | 585/24 |
| 4,332,964 | 6/1982 | Bellmann et al. | 560/141 |
| 4,463,201 | 7/1984 | Schick et al. | 585/10 |
| 4,520,221 | 5/1985 | Chen | 585/517 |
| 4,547,613 | 10/1985 | Garwood et al. | 585/533 |
| 4,849,565 | 7/1989 | Baum et al. | 585/22 |
| 4,912,272 | 3/1990 | Wu | 585/10 |

OTHER PUBLICATIONS

The Chemistry of Diamond Molecules, Raymond C. Fort, Marcel Dekker, New York, 1976.

*Primary Examiner*—Jacqueline V. Howard
*Assistant Examiner*—Maria Nuzzolillo
*Attorney, Agent, or Firm*—Alexander J. McKillop; Charles J. Speciale; Robert B. Furr, Jr.

[57] ABSTRACT

The present invention provides a lubricant additive and lubricant composition comprising the copolymer of 1-vinyladamantane and 1-alkene having from about 4 to about 16 carbon atoms, said copolymer having a Viscosity Index of at least 80 and a kinematic viscosity of at least 6 cS at 212° F. The invention further provides a catalytic method for the preparation of such a copolymer useful as a lubricant stock. In a preferred embodiment of the composition, the 1-alkene is 1-decene. Suitable polymerization catalysts include both acid and coordination catalysts. Useful coordination catalysts include Group VIA metals on an inert support, for example, chromium oxide supported on silica, or Ziegler-Natta catalysts such as $TiCl_4$ and aluminum alkyl, while useful acid catalysts include $BF_3$ and $AlCl_3$, and their appropriate co-catalysts.

27 Claims, 4 Drawing Sheets

V:D = 14:86

V:D = 19:81

V:D = 56:44

LUBRICANT COMPOSITIONS COMPRISING COPOLYMERS OF 1-VINYLADAMANTANE AND 1-ALKENES AND METHODS OF PREPARING THE SAME

FIELD OF THE INVENTION

The present invention relates generally to the field of high performance synthetic lubricants. More particularly, the invention relates to lubricant compositions and methods for synthesizing lubricant compositions which exhibit unexpectedly high viscosity at a given molecular weight. The invention finds particular utility as a synthetic lubricant thickening agent, exhibiting unexpectedly high viscosity at relatively low molecular weight.

BACKGROUND OF THE INVENTION

Adamantane has been found to be a useful building block in the synthesis of a broad range of organic compounds. For a general survey of the chemistry of adamantane and its higher homologs including diamantane and triamantane, see *Adamantane, The Chemistry of Diamond Molecules,* Raymond C. Fort, Marcel Dekker, N.Y., 1976. The following references provide a general overview of adamantane polymer chemistry.

U.S. Pat. No. 3,457,318 to Capaldi et al. teaches the preparations of polymers of alkenyl adamantanes and alkenyl adamantanes useful as coatings, electrical appliance housings, and transformer insulation. The process, yielding polymers bonded through the tetrahedral bridgehead carbons, comprises contacting an adamantyl halide in the presence of a suitable catalyst with a material selected from the group consisting of substituted allyl halides and olefins to produce adamantyl dihaloalkanes or adamantyl haloalkanes as an intermediate product. The intermediate product is then dehalogenated or dehydrohalogenated, respectively, to produce the alkenyl adamantane final product.

U.S. Pat. No. 3,560,578 to Schneider teaches the reaction of adamantane or alkyladamantanes with a $C_3$–$C_4$ alkyl chloride or bromide using $AlCl_3$ or $AlBr_3$ as the catalyst. The reference describes polymerization through $C_3$–$C_4$ linkages connecting bridgehead carbon atoms in the starting adamantane hydrocarbon; See column 3, lines 35–55, as well as the structural illustrations in columns 3–5.

U.S. Pat. No. 3,580,964 to Driscoll discloses polyesters containing hydrocarbyladamantane moieties as well as novel intermediate diesters and crosslinked polymers prepared therefrom. The hydrocarbyladamantane moieties are bonded through the tetrahedral bridgehead carbons; See column 2, lines 6–46 and the diesters illustrated in column 3, lines 55–75.

U.S. Pat. No. 3,639,362 to Dulling et al. discloses novel copolymers having low mold shrinkage properties which are prepared from adamantane acrylate and methacrylates. The adamantane molecule is bonded to the polymer chain through tetrahedral bridgehead carbon atoms.

U.S. Pat. No. 3,649,702 to Pincock et al. discloses a reactive derivative of adamantane, 1,3 dehydroadamantane. The reference shows bridgehead substituents including halogens and alkyls; See column 1, lines 45–64.

U.S. Pat. No. 3,748,359 to Thompson teaches the preparation of an alkyladamantane diamine from an alkyladamantane diacid. The diamine product is illustrated at column 1, lines 20–30, clearly showing bonding through the bridgehead carbons.

U.S. Pat. No. 3,832,332 to Thompson teaches a polyamide polymer prepared from an alkyladamantane diamine. As discussed and illustrated in the Thompson '332 patent at column 2, lines 41–53, the polymer comprises repeating units which include the backbone structure of adamantane. Note that the adamantane structure is bonded to the polymer chain through its bridgehead carbons.

U.S. Pat. No. 3,903,001 to Gates et al. teaches a limited-slip differential lubricant composition which may optionally include adamantane. See in particular the list of $C_{13}$–$C_{29}$ naphthenes at column 4, line 1 et seq.

U.S. Pat. No. 3,966,624 to Duling et al. teaches a power transmission fluid containing a saturated adamantane compound. The adamantane compound consists of adamantane-like structures connected through ester linkages, ether linkages, carboxylic acids, hydroxyl or carbonyl groups; See the Abstract as well as column 1, line 49 through column 2, line 50.

U.S. Pat. No. 3,976,665 to Feinstein et al. discloses a dianhydride containing an adamantane group bonded through the bridgehead carbons.

U.S. Pat. No. 4,043,927 to Duling et al. teaches a tractive drive which may optionally contain an alkyladamantane or alkyladamantanol dimer of the $C_{12}$–$C_{19}$ range containing from 1 to 3 alkyl groups of the $C_1$–$C_3$ range, wherein the dimer contains two adamantane nuclei which are linked together through an alkylene radical derived from and having the same number of carbon atoms as an alkyl group of the starting adamantane material.

U.S. Pat. No. 4,082,723 to Mayer et al. discloses azaadamantane compounds for stabilizing polymers to retard degradation by light and heat. The compounds have an adamantane backbone structure with at least one bridgehead carbon replaced by nitrogen. Specified bridgehead carbons may also be replaced by phosphorus, a phosphoryl or thiophosphoryl group, or a methine group optionally substituted by a phenyl or methyl group; See column 1, line 4 through column 2, line 16. While the Mayer et al. patent teaches replacement of a methylene carbon with nitrogen attached to a substituent group, the reference neither teaches nor suggests polymerizing monomers through octahedrally disposed atoms.

U.S. Pat. No. 4,142,036 to Feinstein et al. discloses adamantane compounds having 2 to 4 bridgehead positions substituted with phenylacyl moieties suitable for producing polymers useful for forming shaped objects such as film, fiber, and molded parts. The ester-substituted adamantanes are also suitable as plasticizers for polyvinylchloride and other polymers. The Feinstein et al. '036 patent notes that the four bridgehead carbons are equivalent to each other and are also more susceptible to attack than the secondary carbons. Accordingly, the adamantane component of the polymer taught in Feinstein et al. '036 bonds through the tetrahedrally disposed bridgehead carbons.

U.S. Pat. No. 4,168,260 to Weizer et al. teaches nitrogen-substituted triaza-adamantanyl ureas useful as stabilizers for thermoplastic materials. Nitrogen replaces carbon in three of the four bridgehead positions.

U.S. Pat. No. 4,332,964 to Bellmann et al. discloses diacrylate and dimethacrylate esters containing bridegehead substituted adamantane monomers. The polymer synthesis technique disclosed at col[illegible] 3, line 62 through column 7, line 61 includes halogen addition at bridgehead carbons followed by replacement of the halogen with the selected link of the polymer chain.

The following references are representative of the art of lubricant-grade synthetic oligomers.

U.S. Pat. Nos. 3,676,521, 3,737,477, 3,851,011, and 3,923,919 to Stearns et al. teach lubricants having high Viscosity Index, low pour point, and high stability which comprise ethylene-propylene copolymers produced from monoolefin mixtures containing ethylene and propylene over catalysts including vanadium-aluminum or titanium-aluminum Ziegler-type catalyst systems.

U.S. Pat. No. 3,972,243 to Driscoll et al. discloses compositions including traction fluids, antiwear additives, as well as lubricant stocks containing a gem-structured hydrocarbon backbone, which compositions are produced by ozonolysis of polyolefins, particularly polyisobutylene oligomers.

U.S. Pat. No. 4,182,922 to Schick et al. teaches a synthetic hydrocarbon oil and a method of making the same involving the copolymerization of propylene or propylene plus higher 1-olefins with small amounts of ethylene.

U.S. Pat. No. 4,239,927 to Brennan et al. relates to a process for producing synthetic hydrocarbon oils by the polymerization of olefins using an aluminum halide catalyst. More specifically, the reference provides a method for preventing accumulation of certain organic halides which were found to be corrosive to process equipment by reacting such organic halides with aromatic hydrocarbons to evolve an alkylation product.

U.S. Pat. No. 4,463,201 to Schick et al. discloses a process for producing high quality synthetic lubricating oils by the copolymerization of ethylene, propylene, and a third 1-olefin, and subsequently dewaxed via a urea adduction process.

U.S. Pat. No. 4,520,221 to Chen teaches a process for producing high Viscosity Index lubricants from light olefins over a catalyst having the structure of ZSM-5, the surface acidity of which has been inactivated by treatment with a suitable base material.

U.S. Pat. No. 4,547,613 to Garwood et al. teaches the conversion of olefin-rich hydrocarbon streams such as ethylene and containing up to about 16 carbon atoms to high Viscosity Index lubricant base stocks by contacting the olefins with a catalyst having the structure of ZSM-5 under elevated pressure.

U.S. Pat. No. 4,912,272 to Wu relates to lubricant mixtures having unexpectedly high viscosity indices. More specifically, the lubricant mixtures comprise blends of high Viscosity Index polyalphaolefins prepared with activated chromium on silica, polyalphaolefins prepared with $BF_3$, aluminum chloride, or Ziegler-type catalysts.

The preceding references elucidate several advantageous aspects of synthetic lubricant, including high Viscosity Index, as well as good lubricity and thermal stability. Thus it would be highly desirable to provide a relatively low molecular weight high viscosity synthetic lubricant blending stock for increasing the kinematic viscosity of blended synthetic lubricants.

SUMMARY OF THE INVENTION

Synthetic lubricant additives and mineral oil- or synthetic oil-based lubricant mixtures containing such additives have been discovered which exhibit surprisingly high viscosities at relatively low molecular weights. These lubricant additives comprise copolymers of 1-vinyladamantane and at least one 1-alkene having from about 4 to about 16 carbon atoms, which copolymer have a Viscosity Index of at least 85 and a kinematic viscosity of at least 10 cS at 212° F.

The invention further includes a method for producing a copolymeric lubricant additive having a Viscosity Index of at least 85 and a kinematic viscosity of at least 10 cS at 212° F. by contacting a mixture of 1-vinyladamantane and a 1-alkene having from about 4 to about 16 carbon atoms with at least one selected from the group consisting of a Group VIA metal and a Lewis acid.

DESCRIPTION OF THE DRAWINGS

FIG. 2*a* shows the C-13 NMR spectra of a 1-vinyladamantane:decene-1 copolymer having a 1-vinyladamantane:decene-1 molar ratio of 14:86.

FIG. 2*b* shows the C-13 NMR spectra of a 1-vinyladamantane:decene-1 copolymer having a 1-vinyladamantane:decene-1 molar ratio of 19:81.

FIG. 2*c* shows the C-13 NMR spectra of a 1-vinyladamantane:decene-1 copolymer having a 1-vinyladamantane:decene-1 molar ratio of 56:44.

DETAILED DESCRIPTION OF THE INVENTION

Figure 1A:
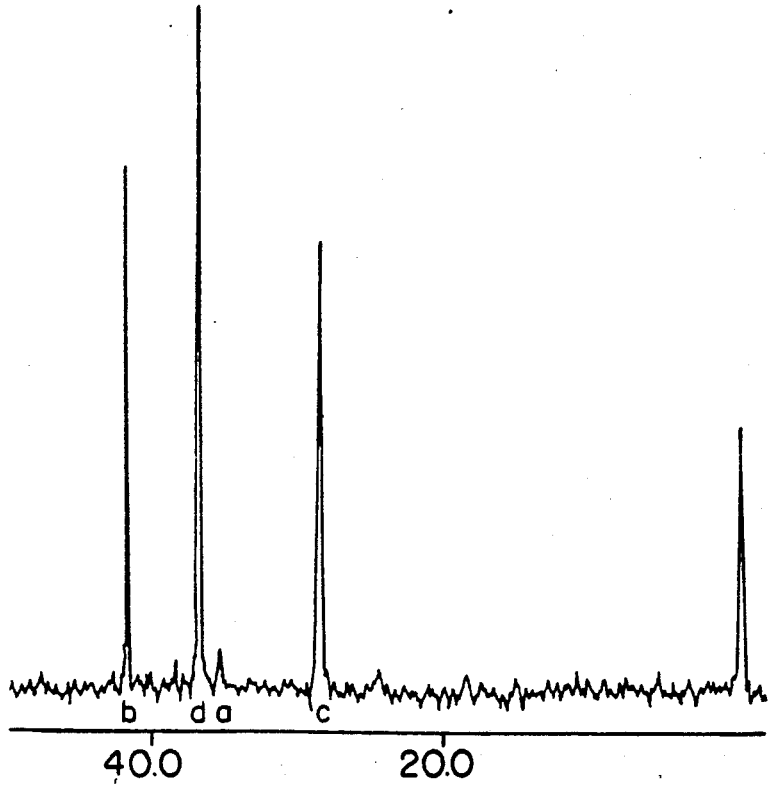
FIGS. 1*a* and 1*b* show the C-13 NMR (0–50ppm) spectra of 1-vinyladamantane and polydecene-1, respectively as standards.

The new synthetic lubricant stocks disclosed herein include copolymers of 1-vinyladamantane and at least one 1-alkene having from about 4 to about 16 carbon atoms which are present in molar ratios of 1-vinyladamantane:1-alkene of from about 1:10 to about 1:1.

FEEDSTOCKS

The feedstocks useful in the present invention include 1-vinyladamantane and at least one 1-alkene having from about 4 to about 16 carbon atoms. Particularly preferred among these 1-alkenes, is 1-decene. Olefins useful in the present invention are commonly referred to by any one of several synonyms, including "1-olefin", "olefin-1", "alkene-1", and "alpha-olefin".

The molar ratio of 1-vinyladamantane:1-alkene in the feedstock may suitably range from about 1:100 to about 1:1, preferably from about 1:10 to about 1:1. The 1-vinyladamantane:1-alkene molar ratio in the feed should be the same or close to the desired ratio in the final copolymeric product. It is advisable to use a feed having a molar ratio of 1-vinyladamantane:1-alkene up to about 1:1 because 1-vinyladamantane has not been found to homopolymeri over Group VIA metal catalysts such as Cr, and homopolymerizes with low activity over Lewis acid catalysts such as $AlCl_3$. Thus significant amounts of excess 1-vinyladamantane would be expected to retard the copolymerization reaction.

The beneficial thickening effects of 1-vinyladamantnae copolymerization become markedly evident at a minimum molar ratio of 1-vinyladamantane:1-alkene of about 1:5, as indicated by surprisingly elevated kinematic viscosities for the measured polymeric molecular weight. Feedstock composition is a critical variable in tailoring the resulting copolymers to a particular application. The thickening effect is most pronounced at relatively high 1-vinyladamantane:1-alkene ratios of from about 1:5 to about 1:1.

CATALYSTS

Catalysts useful for producing the 1-vinyladamantane:1-alkene copolymer of the present invention include metals as well as solid and liquid acidic catalysts.

Suitable coordination catalysts include the metals of Group VIA of the Periodic Table of the Elements, which Table is published under catalog number S-18806 by the Sargent-Welch Scientific Company, 7300 North Linder Avenue, Skokie, Ill., 60077. Members of Group VIA of the Periodic Table of the Elements include chromium, molybdenum, and tungsten, of which chromium is most preferred. Useful coordination catalysts further include Ziegler-Natta catalysts such as $TiCl_4$ and aluminum alkyl.

U.S. Pat. No. 4,912,272 to Wu, cited above, teaches a method for the production of polyalphaolefins using catalysts including activated chromium on silica, $BF_3$, aluminum chloride, and Ziegler-type catalysts, and is incorporated by reference as if set forth at length herein for details of olefin polymerization.

The metal catalyst is preferably supported on an inert carrier, as exemplified by chromium oxide supported on silica. In practicing the copolymerization process of the invention using a solid Group VIA metal-containing catalyst, it may be useful to deposit the Group VIA metal on a matrix comprising another material resistant to the temperature and other conditions employed in such processes. Such matrix materials include synthetic or naturally occurring substances as well as inorganic materials such as clay, silica and/or metal oxides. The latter may be either naturally occurring or in the form of gelatinous precipitates or gels including mixtures of silica and metal oxides. Naturally occurring clays which can be composited with the catalytically active metal include those of the montmorillonite and kaolin families, which families include the sub-bentonites and the kaolins commonly known as Dixie, McNamee-Georgia and Florida clays or others in which the main mineral constitutent is halloysite, kaolinite, dickite, nacrite or anauxite. Such clays can be used in the raw state as originally mined or initially subjected to calcination, acid treatment or chemical modification.

In addition to the foregoing materials, the catalytically active Group VIA metals employed herein may be composited with a porous matrix material, such as alumina, silica-alumina, silica-magnesia, silica-zirconia, silica-thoria, silica-beryllia, and silica-titania, as well as ternary compositions, such as silica-alumina-thoria, silica-alumina-zirconia, silica-alumina-magnesia and silica-magnesia-zirconia. The matrix may be in the form of a cogel. The relative proportions of catalytically active Group VIA metal component and inorganic oxide gel matrix, on an anhydrous basis, may vary widely with the catalytically active metal content ranging from between about 1 to about 10 percent by weight and more usually in the range of about 1 to about 3 percent by weight of the dry composite.

Useful liquid acidic catalysts are exemplified by $BF_3$ complexes, as well as by a solution or complex of an aluminum halide, such as the chloride or bromide, dissolved in an ester, with the solution or complex containing more than one mole of the halide per mole of ester. In general, the amount of, for example, aluminum halide dissolved per mole of ester in the aluminum halide liquid catalyst system will be between about 1.1 and about 1.4 moles. Other useful Lewis acid-containing catalyst systems may employ other solvents such as alcohols or water. One example of such a catalyst system is $AlCl_3$:-$H_2O$. For a discussion of liquid aluminum halide catalysts in synthetic lubricant synthesis from olefins, see U.S. Pat. No. 4,239,927 to Brennan et al., cited above, and incorporated by reference as if set forth at length herein.

CONVERSION CONDITIONS

Process conditions useful for synthesizing the copolymeric lubricant additives of the present invention are shown below in Tables 1 and 2.

TABLE 1

Catalyst: Coordination Catalyst, e.g., Cr supported on $SiO_2$.

| | Broad Range | Preferred Range |
|---|---|---|
| Temperature | 25–200° C. | 70–110° C. |
| Pressure | 50–1000 psig | 100–300 psig |
| Contact Time | 4–100 hrs. | 4–16 hrs. |

TABLE 2

Catalyst: Acidic Catalyst, e.g., $AlCl_3$:$H_2O$ (molar ratio 1:1) or $BF_3$:n-propyl alcohol (molar ratio 1:1)

| | Broad Range | Preferred Range |
|---|---|---|
| Temperature | 0–200° C. | 25–50° C. |
| Pressure | 50–1000 psig | 100–300 psig |
| Contact Time | 4–100 hrs. | 4–16 hrs. |

EXAMPLES

Examples I–III

1-Vinyladamantane and decene-1 copolymers prepared by chromium catalysis

The chromium catalyst was 3% chromium by weight on silica activated in CO at 800° C. The chromium catalyzed copolymerization was carried out in a Parr reactor equipped with a stirrer, a sampling outlet and a catalyst addition device affixed to the reactor head. In a glove box, the monomers were charged into the reactor, and the catalyst was weighed into the detached device. The catalyst device was reattached to the reactor head. The reactor was then closed with the head. It was taken out from the glove box and assembled in the laboratory for polymerization. The monomer mixture was heated to a predesignated temperature with stirring and the catalyst was injected into the monomers by applying a nitrogen pressure. A nitrogen pressure was maintained in the reactor for sampling during the polymerization. Samples were withdrawn periodically and analyzed by GC (gas chromatograph) to follow the disappearance of monomers. When the polymerization was complete, or when there was no more change detected, the reactor was cooled down and the pressure was released. The catalyst was filtered off and the reaction product was distilled to remove the light materials and to obtain the lube molecular weight fraction. Table 3 summarizes the results.

TABLE 3

Copolymerization of 1-vinyladamantane and decene-1 by chromium catalysis and product properties.

| | Monomers | | Cr | | Lube M. W. range product | | | | |
|---|---|---|---|---|---|---|---|---|---|
| | Decene | 1-VAD | Catalyst | Temp | Yield | Kv(cS) | | | |
| Example | g | g(M %) | g | °C. | % | 104° F. | 212° F. | VI | Mw |
| I | 35.0 | 5.45(13.8) | 3.0 | 110 | 89 | 900.7 | 85.28 | 179.0 | |
| II | 33.3 | 7.70(19.2) | 4.0 | 110 | 95 | 547.0 | 53.99 | 162.1 | 5465 |
| III | 7.90 | 9.68(55.9) | 2.4 | 110 | 96 | 1177.7 | 50.23 | 85.3 | 1278 |

Figure 1B:
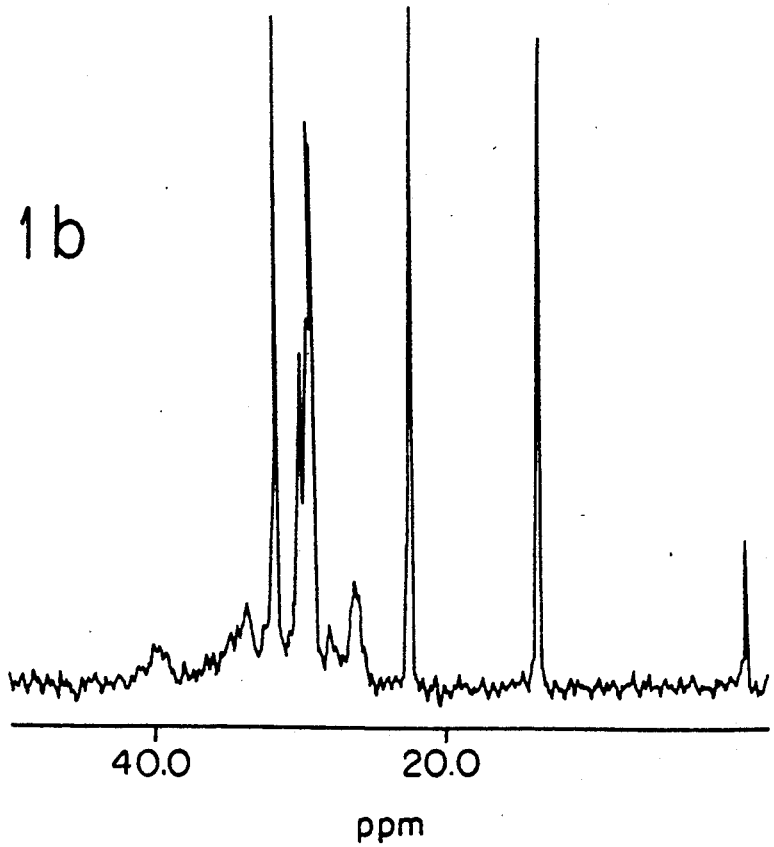
Figure 2A:
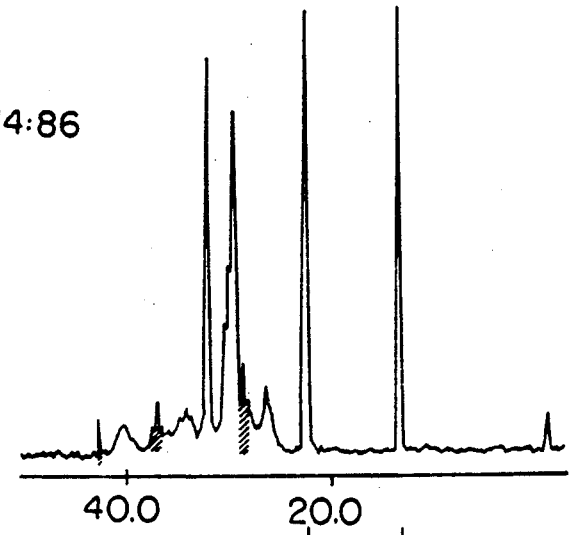
FIGS. 2*a*–2*c* show the C-13 NMR spectra of the 1-vinyladamantane:decene-1 copolymers described in Examples I–III.
Figure 2B:
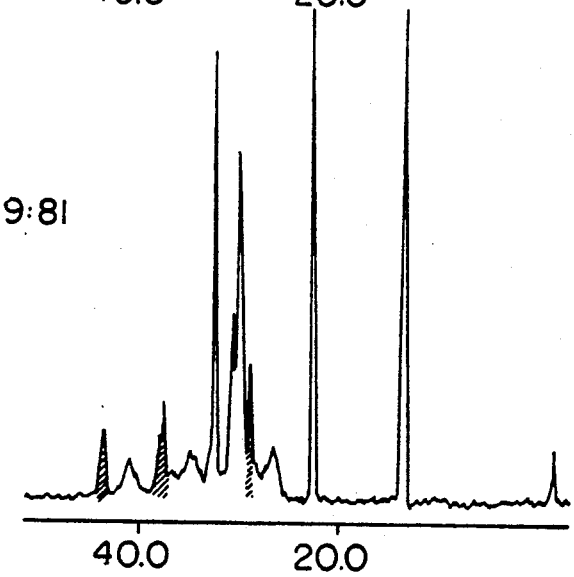
Figure 2C:
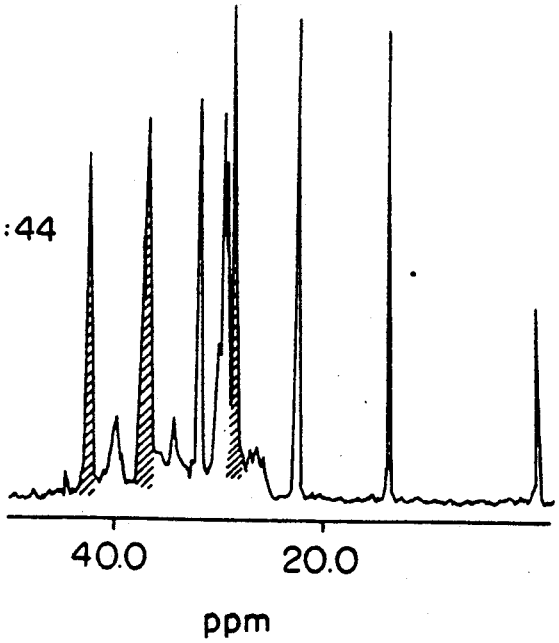

The presence of adamantane structure in the copolymers is shown in FIGS. 1-2. FIG. 1 shows the C-13 NMR spectra of 1-vinyladamantane and polydecene-1 as standards. FIG. 2 shows the C-13 spectra of the copolymers described in Examples I-III. The shaded peaks are attributed to the adamantane structure. Results in Table 3 show that lubes of different viscosities and different viscosity indices can be obtained by varying the copolymer composition. Results also show that 1-adamantane affects a thicking of the copolymers as evidenced by their kinematic viscosity which is particularly surprising in view of their relatively low molecular weight. The copolymer in Example III has a far lower molecular weight but a far higher viscosity than the copolymer in Example II. This is believed to be attributable to the fact that the copolymer of Example III incorporates a larger molar percentage of 1-vinyladamantane in its molecular structure than the copolymer of Example II. Viscosity Index generally decreases with increasing 1-vinyladamantane content in the copolymer. Thus by varying the relative amounts of 1-vinyladamantane and decene in the copolymer, the kinematic viscosity and Viscosity Index may be tailored to achieve the most desirable combination for a particular application.

Examples IV-V

1-Adamantane and Decene-1 copolymers prepared by aluminum chloride catalysis The aluminum chloride-catalyzed copolymerization was carried out in a 4-neck flask equipped with a nitrogen inlet, a condenser with a drying tube, a catalyst feeder, and a device for sampling during the reaction.

In a glove box, the monomers were weighed into the flask, a calculated amount (based on the amount of aluminum chloride used) of distilled water (cocatalyst) was added using a microsyringe. The molar ratio of aluminum chloride to water was 1:1. The catalyst was weighed into the feeder. The flask was closed, taken out of the glove box and assembled in the laboratory. While nitrogen was flowing through the flask, a stopper was replaced with the condenser. The reactants were heated to a predesignated temperature and the aluminum chloride was added. Samples were withdrawn periodically and analyzed by GC to follow the disappearance of the monomers. After the polymerization, the product was washed twice with 5% HCl, twice with 5% NaOH, twice with water, and dried over anhydrous $MgSO_4$. The dried product was distilled to remove lower boiling materials and to obtain products in the lube range molecular weight. The results are summarized in Table 4.

TABLE 4

Copolymerization of 1-vinyladamantane and decene-1 catalyzed by aluminum chloride and product properties

| | Monomers | | | | Lube Mol. Wt. product | | | |
|---|---|---|---|---|---|---|---|---|
| | Decene | 1-VAD | $AlCl_3$ | Temp | Yield | Kv(cS) | | |
| Example | g | g(M %) | g | °C. | % | 104° F. | 212° F. | VI |
| IV | 45 | 5(10.4) | 1.0 | 50 | 92 | 140.81 | 16.83 | 129.0 |
| | | (Exoth. to 97° C. in minutes) | | | | | | |
| V | 45 | 5(10.4) | 2.0 | 50 | 87 | 116.8 | 14.42 | 125.0 |
| | | (Exoth. to 170° C. in minutes) | | | | | | |

Figure 3A:
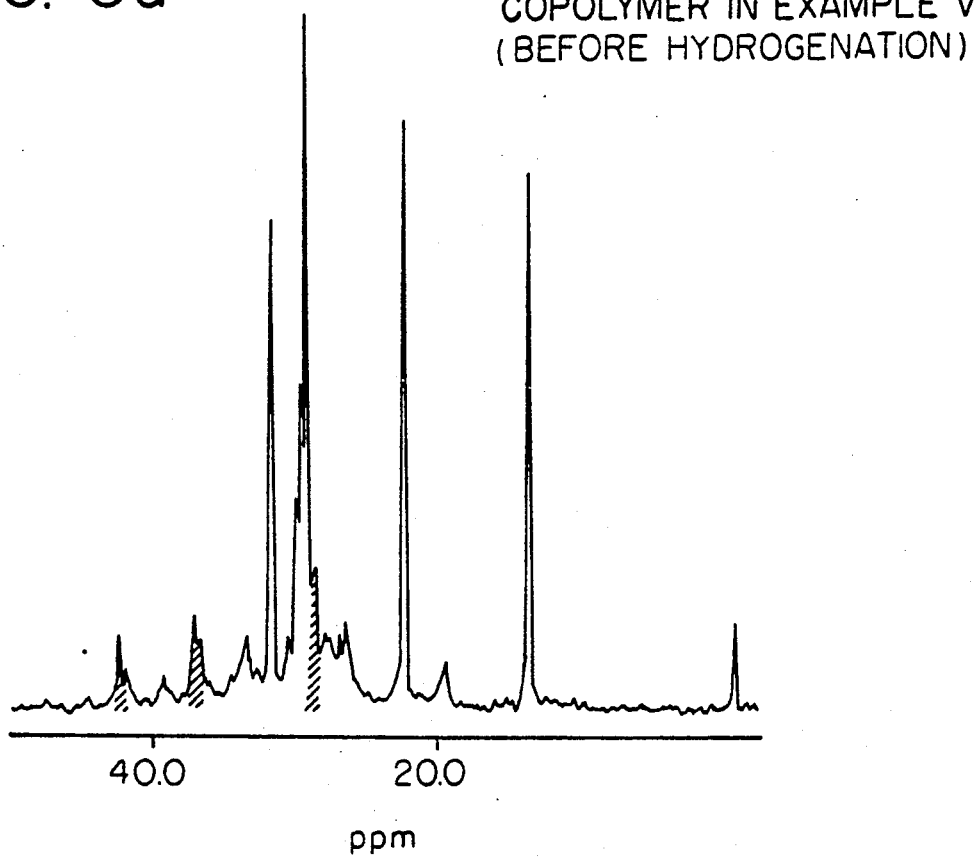
FIG. 3*a* shows the C-13 NMR spectrum (0–50 ppm) of a 1-vinyladamantane:decene-1 copolymer having a molar ratio of 1-vinyladamantane:decene-1 of 1:9 before hydrogenation as described in Example V.
Figure 3B:
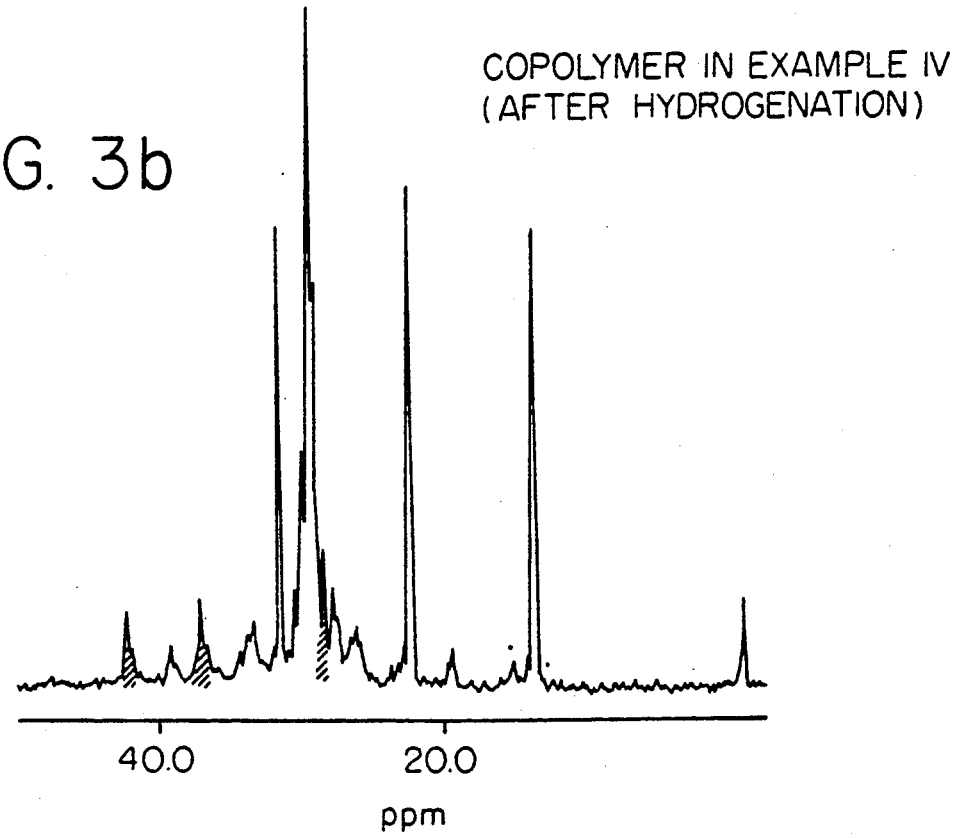
FIG. 3*b* shows the C-13 NMR spectrum (0–50 ppm) of a 1-vinyladamantane:decene-1 copolymer having a molar ratio of 1-vinyladamantane:decene-1 of 1:9 after hydrogenation as described in Example IV.

The copolymerization was complete in minutes. FIG. 3 shows the C-13 NMR results of the copolymers obtained in Examples IV and V. The properties shown below in Table 5 indicate that 1-vinyladamantane:decene-1 copolymers are useful lubricant stocks, exhibiting desirable pour point and cloud point characteristics.

TABLE 5

Low temperature properties of 1-vinyladamantane and decene-1 copolymers

| Copolymer | Catalyst | M % 1-VAD | Pour Pt., °C. | Cloud Pt., °C. |
|---|---|---|---|---|
| Example II | Cr | 19.2 | −35.4; −35.2 | −35.4 |
| Example IV | $AlCl_3$ | 10.4 | −36.8; −36.6 | −32.5 |

Changes and modifications in the specifically described embodiments can be carried out without departing from the scope of the invention which is intended to be limited only by the scope of the appended claims.

What is claimed is:

1. A lubricant additive having the structure shown in FIG. 4 wherein n is from about 1 to about 9 and x is from about 4 to about 30.

2. The lubricant additive of claim 1 wherein n is from about 1 to about 4.

3. The lubricant additive of claim 1 wherein n is 1.

Figure 4:
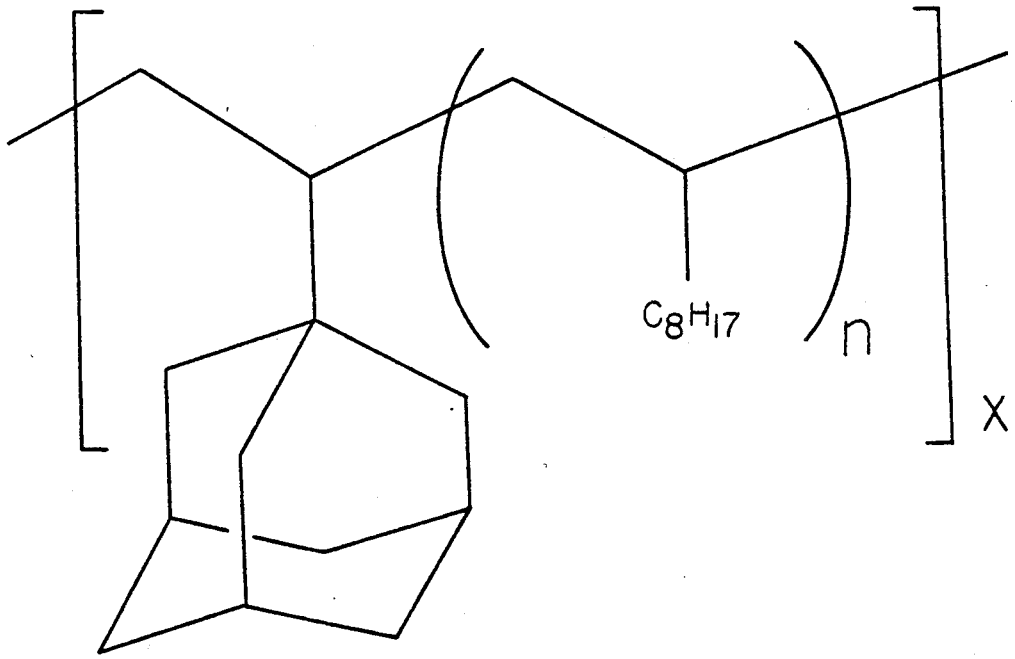
FIG. 4 is a structural schematic diagram showing the chemical structure of the lubricant additive composition of the invention, wherein n is from about 1 to about 9 and x is from about 4 to about 30.

4. A lubricant composition comprising:

(a) a compound having the structure shown in FIG. 4 wherein n is from about 1 to about 9 and x is from about 4 to about 30; and (b) at least one lubricating stock selected from the group consisting of mineral oil lubricating stocks, synthetic oil lubricating stocks, and mixtures thereof.

5. The lubricant composition of claim 4 wherein n is from about 1 to about 4.

6. The lubricant composition of claim 4 wherein n is 1.

7. A lubricant composition comprising the copolymer of 1-vinyladamantane and a 1-alkene having from about 4 to about 16 carbon atoms, said copolymer having a Viscosity Index of at least 80 and a kinematic viscosity of at least 6 cS at 212° F.

8. The lubricant of claim 7 wherein said 1-alkene is 1-decene.

9. The lubricant of claim 8 wherein said copolymer comprises at least 90 mole percent 1-decene.

10. The lubricant of claim 9 wherein said copolymer has a Viscosity Index of at least 80.

11. The lubricant of claim 7 wherein said copolymer comprises the oligomerization product of 1-vinyladamantane and 1-alkene catalyzed by acid catalyst.

12. The lubricant of claim 11 wherein said acid catalyst is at least one selected from the group consisting of $AlCl_3$ and $BF_3$.

13. The lubricant of claim 11 wherein said 1-alkene is 1-decene and said oligomerization product comprises polyalphadecene.

14. The lubricant of claim 7 wherein said copolymer comprises the oligmerization product of 1-vinyladamantane and 1-alkene in contact with a Group VIA metal on an inert support.

15. The lubricant of claim 14 wherein said copolymer comprises the oligmerization product of 1-vinyladamantane and 1-alkene in contact with chromium oxide supported on silica.

16. The lubricant of claim 14 wherein said alkene-1 is decene-1.

17. The lubricant of claim 7 further comprising at least one lubricant additive selected from the group consisting of antioxidants, dispersants, extreme pressure additives, friction modifiers, detergents, corrosion inhibitors, antifoamants and Viscosity Index improvers.

18. A lubricant composition comprising the copolymer of 1-vinyladamantane and 1-decene having the structure shown in FIG. 4 wherein n is from about 1 to about 9 and x is from about 4 to about 30, said copolymer having a pour point of less than about −20° C. and a cloud point of less than −20° C.

19. The lubricant composition of claim 18 wherein the 1-vinyladamantane:1-decene molar ratio is from about 1:10 to about 1:1.

20. A method for producing a copolymeric lubricant additive having a Viscosity Index of at least 80 and a kinematic viscosity of at least 6 cS at 212° F. by contacting a mixture of 1-vinyladamantane and a 1-alkene having from about 4 to about 16 carbon atoms with at least one selected from the group consisting of a Group VIA metal and a Lewis acid.

21. The method of claim 20 wherein said copolymeric lubricant additive has the structure shown in FIG. 4 wherein n is from about 1 to about 9 and x is from about 4 to about 30

22. The method of claim 21 wherein said 1-alkene is 1-decene.

23. The method of claim 20 further comprising contacting 1-alkene and 1-vinyladamantane with an acid catalyst.

24. The method of claim 23 wherein said acid catalyst is at least one selected from the group consisting of $AlCl_3$ and $BF_3$.

25. The method of claim 20 further comprising contacting 1-alkene and 1-vinyladamantane with a Group VIA metal on an insert support.

26. The method of claim 25 wherein said Group VIA metal is Cr.

27. The method of claim 26 further comprising contacting 1-alkene and 1-vinyladamantane with chromium oxide supported on silica.

* * * * *